US009395067B2

(12) United States Patent
Musser et al.

(10) Patent No.: US 9,395,067 B2
(45) Date of Patent: Jul. 19, 2016

(54) METHOD OF AND APPARATUS FOR ENHANCED THERMAL ISOLATION OF LOW-PROFILE LED LIGHTING FIXTURES

(71) Applicant: Flextronics AP, LLC, Broomfield, CO (US)

(72) Inventors: Jordon Musser, Dallas, TX (US); Randall Jones, Overland Park, KS (US); Corey Barkhurst, Harrisonville, MO (US)

(73) Assignee: Flextronics AP, LLC, Broomfield, CO (US)

( * ) Notice: Subject to any disclaimer, the term of this patent is extended or adjusted under 35 U.S.C. 154(b) by 74 days.

(21) Appl. No.: 14/507,077

(22) Filed: Oct. 6, 2014

(65) Prior Publication Data

US 2015/0098214 A1 Apr. 9, 2015

Related U.S. Application Data

(60) Provisional application No. 61/887,838, filed on Oct. 7, 2013.

(51) Int. Cl.

| | |
|---|---|
| ***F21V 11/00*** | (2015.01) |
| ***F21V 15/01*** | (2006.01) |
| ***F21V 29/507*** | (2015.01) |
| ***F21V 29/15*** | (2015.01) |
| ***F21V 29/505*** | (2015.01) |
| ***F21V 29/83*** | (2015.01) |
| ***F21V 23/00*** | (2015.01) |
| *F21V 5/04* | (2006.01) |
| *F21Y 101/02* | (2006.01) |
| *F21Y 105/00* | (2016.01) |
| *F21V 23/02* | (2006.01) |
| *F21Y 113/00* | (2016.01) |
| *F21V 29/508* | (2015.01) |

(52) U.S. Cl.

CPC ..... *F21V 15/01* (2013.01); *F21V 23/009* (2013.01); *F21V 29/15* (2015.01); *F21V 29/505* (2015.01); *F21V 29/507* (2015.01); *F21V 29/83* (2015.01); *F21V 5/04* (2013.01); *F21V 23/02* (2013.01); *F21V 29/508* (2015.01); *F21Y 2101/02* (2013.01); *F21Y 2105/00* (2013.01); *F21Y 2105/001* (2013.01); *F21Y 2113/00* (2013.01); *Y10T 29/49117* (2015.01)

(58) Field of Classification Search

CPC ..... F21V 23/003–23/026
USPC ..... 362/237, 240, 241, 249.02, 221, 362/224–225

See application file for complete search history.

(56) References Cited

U.S. PATENT DOCUMENTS

| | | | |
|---|---|---|---|
| 4,729,076 | A | 3/1988 | Masami et al. |
| 5,632,551 | A | 5/1997 | Roney et al. |
| RE36,414 | E | 11/1999 | Tickner |
| 6,882,111 | B2 | 4/2005 | Kan et al. |
| 7,259,403 | B2 | 8/2007 | Shimizu |
| 7,338,186 | B1 | 3/2008 | Wu et al. |

(Continued)

*Primary Examiner* — Sean Gramling
(74) *Attorney, Agent, or Firm* — Haverstock & Owens LLP

(57) ABSTRACT

A LED assembly/structure and a method of manufacturing the same. The LED assembly comprises a housing body, one or more LED light emitting component hosting areas, a power unit hosting compartment, one or more light diffusing elements, and a cover. The housing body of the LED assembly serves as a thermal barrier between the power supply and the LED lighting elements, such that thermal stress is able to be reduced.

18 Claims, 4 Drawing Sheets

(56) References Cited

U.S. PATENT DOCUMENTS

| | | | |
|---|---|---|---|
| 7,455,444 | B2 | 11/2008 | Chien |
| 7,611,261 | B2 | 11/2009 | Richmond et al. |
| 7,674,025 | B2 | 3/2010 | Liesener |
| 7,682,853 | B2 | 3/2010 | Ashida |
| 7,938,558 | B2 | 5/2011 | Wilcox et al. |
| 8,128,260 | B2 | 3/2012 | Ariyoshi |
| 8,227,269 | B2 | 7/2012 | Chen et al. |
| 8,227,969 | B2 | 7/2012 | Yamaguchi et al. |
| 8,228,261 | B2 | 7/2012 | Callegari |
| 8,231,254 | B2 | 7/2012 | Beck et al. |
| D687,179 | S | 7/2013 | Kim |
| 8,591,051 | B2 | 11/2013 | Nakajima et al. |
| 8,661,660 | B2 | 3/2014 | Ter-Hovhannissian |
| 8,696,951 | B2 | 4/2014 | Takase et al. |
| 2001/0042865 | A1 | 11/2001 | Oshio et al. |
| 2005/0007769 | A1 | 1/2005 | Bonzer et al. |
| 2006/0044806 | A1 | 3/2006 | Abramov et al. |
| 2006/0186430 | A1 | 8/2006 | Park et al. |
| 2008/0048200 | A1 | 2/2008 | Mueller et al. |
| 2009/0179207 | A1 | 7/2009 | Chitnis et al. |
| 2010/0295070 | A1 | 11/2010 | Su et al. |
| 2010/0295077 | A1 | 11/2010 | Melman |
| 2011/0018017 | A1 | 1/2011 | Bierhuizen et al. |
| 2011/0051413 | A1 | 3/2011 | Hand |
| 2011/0058358 | A1* | 3/2011 | Soo ..... F21S 4/008 362/147 |
| 2011/0063836 | A1 | 3/2011 | Salm |
| 2011/0085336 | A1 | 4/2011 | Blumel et al. |
| 2011/0228517 | A1 | 9/2011 | Kawabat et al. |
| 2012/0097985 | A1 | 4/2012 | Liu et al. |
| 2012/0205697 | A1 | 8/2012 | Kim et al. |
| 2012/0218746 | A1 | 8/2012 | Winton |
| 2013/0027906 | A1 | 1/2013 | Ueda et al. |
| 2013/0050998 | A1 | 2/2013 | Chu et al. |
| 2013/0051001 | A1 | 2/2013 | Muskin |
| 2013/0155674 | A1 | 6/2013 | Park et al. |
| 2013/0182425 | A1 | 7/2013 | Seki et al. |
| 2014/0043810 | A1 | 2/2014 | Jo et al. |
| 2014/0119032 | A1 | 5/2014 | Wimbert et al. |

* cited by examiner

METHOD OF AND APPARATUS FOR ENHANCED THERMAL ISOLATION OF LOW-PROFILE LED LIGHTING FIXTURES

CROSS-REFERENCE TO RELATED APPLICATION(S)

This application claims priority under 35 U.S.C. §119(e) of the U.S. Provisional Patent Application Ser. No. 61/887,838, filed Oct. 7, 2013 and titled, "METHOD AND APPARATUS FOR ENHANCED THERMAL ISOLATION OF LOW-PROFILE LED LIGHTING FIXTURES FOR COMMERCIAL AND RESIDENTIAL APPLICATIONS," which is also hereby incorporated by reference in its entirety for all purposes.

FIELD OF THE INVENTION

The present invention relates to the field of lighting assembly. More specifically, the present invention relates to LED (light emitting diode) hosing structure and materials.

BACKGROUND OF THE INVENTION

Typically LED assembly comprises complicated stamped structures and often with many screws. The typically LED assembly also include many parts, which adds more manufacturing labors and costs.

SUMMARY OF THE INVENTION

An LED assembly and the method of manufacturing the same. The LED assembly comprises a housing body, one or more LED light emitting component hosting areas, a power unit hosting compartment, one or more light diffusing elements, and a cover.

In an aspect, a method of manufacturing a LED assembly comprises coupling formed sheet metal to form a housing body, wherein the housing body comprising at least two recesses, coupling at least one LED lighting element with each of the at least two recesses, enclosing a power supply, and coupling one or more diffusing lens to each of the LED lighting element.

In some embodiments, the housing body comprises at least three pieces of metal sheets. In other embodiments, the two recesses are at the two sides of the power supply. In some other embodiments, each of the two recesses comprises a flat area coupling with the LED lighting element. In some embodiments, the method further comprises assembling the housing body without using a screw.

In another aspect, a lighting assembly comprising a housing body having an enclosed power supply compartment and a portion of the housing body form a thermal barrier between the power supply and one or more LED panels. In some embodiments, the housing body is formed by attaching formed metal sheets to one another. In other embodiments, the LED panels are provided or with one or more diffusing lens. In some other embodiments, the LED panels are at two sides of the power supply. In some embodiments, the housing body comprises two recesses couples with two LED lighting elements. In other embodiments, the lighting assembly further comprises a cover, wherein the cover covers the power supply compartment holding the power supply. In some other embodiments, the cover is a perforated stamped piece. In some embodiments, the housing body comprises a thermally reflective coating. In some other embodiments, the lighting assembly couples with an LED or LED array greater than 100 Watts.

In another aspect, a low-profile LED lighting fixture comprises a body having a thickness less than 70 mm, two lighting areas located at two sides of the fixture, a concave surface mounting area at each of the two lighting areas, and a diffusing lens covering each of the lighting areas. In some embodiments, the low-profile LED lighting fixture further comprises two rows of holes facing each other. In other embodiments, the holes are heat dissipating holes located around a power supply. In some other embodiments, the low-profile LED lighting fixture further comprises a thermal barrier between the power supply and a LED lighting element. In some embodiments, the body is formed by three pieces of formed sheet metal. In other embodiments, the diffusing lens is lower than a side wall of the body.

Other features and advantages of the present invention will become apparent after reviewing the detailed description of the embodiments set forth below.

BRIEF DESCRIPTION OF THE DRAWINGS

Embodiments will now be described by way of examples, with reference to the accompanying drawings which are meant to be exemplary and not limiting. For all figures mentioned herein, like numbered elements refer to like elements throughout.

DETAILED DESCRIPTION OF THE PREFERRED EMBODIMENT

Reference is made in detail to the embodiments of the present invention, examples of which are illustrated in the accompanying drawings. While the invention is described in conjunction with the embodiments below, it is understood that they are not intended to limit the invention to these embodiments and examples. On the contrary, the invention is intended to cover alternatives, modifications and equivalents, which can be included within the spirit and scope of the invention as defined by the appended claims. Furthermore, in the following detailed description of the present invention, numerous specific details are set forth in order to more fully illustrate the present invention. However, it is apparent to one of ordinary skill in the prior art having the benefit of this disclosure that the present invention can be practiced without these specific details. In other instances, well-known methods and procedures, components and processes have not been described in detail so as not to unnecessarily obscure aspects of the present invention. It is, of course, appreciated that in the development of any such actual implementation, numerous implementation-specific decisions must be made in order to achieve the developer's specific goals, such as compliance with application and business related constraints, and that these specific goals are vary from one implementation to another and from one developer to another. Moreover, it is appreciated that such a development effort can be complex and time-consuming, but is nevertheless a routine undertaking of engineering for those of ordinary skill in the art having the benefit of this disclosure.

Figure 1:
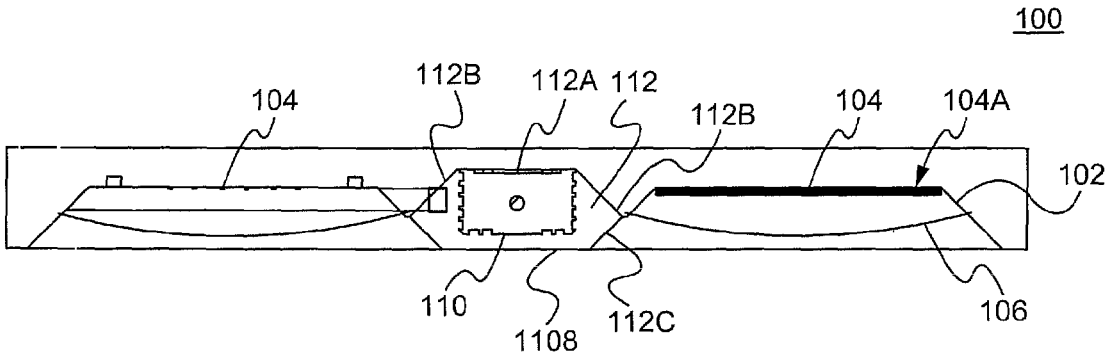
FIG. 1 illustrates an LED assembly 100 in accordance with some embodiments of the present invention.

FIG. 1 illustrates an LED assembly 100 in accordance with some embodiments of the present invention. FIG. 1 is a side cut-out view of the LED assembly 100. The LED assembly 100 can include a housing body 102, an LED panel 104, one or more diffusing lens 106, and a power supply 110. In some embodiments, the LED assembly 100 is a four piece LED fixture, which can be functionally similar to a 2X fluorescent fixture. The housing body 102 can be a two pieces component when assembled with the LED lighting generating elements, such as the LED panel 104. The LED panel 104 can comprises light emitting dies. The housing body 102 can be constructed by attaching 3 pieces of formed/shaped sheet metal. The attaching of the 3 pieces of sheet metal can be attached together with a clip structure/force. In some embodiments, the pieces of sheet metal are secured together via complimentary shapes. A person of ordinary skill in the art appreciates that any other methods and/or structures can be used to attach the pieces together.

In some embodiments, a cover 108 is a perforated and a stamped piece. In some embodiments, the cover 108 covers the compartment 112 holding the LED power supply 110. The compartment 112 can comprise an area 112A for attaching the LED power supply 110. The area 112A can be a flat surface.

In some embodiments, one or more diffusers 106 couple with the housing body 102. The diffusers 106 can cover the LED panel 104, which fit in front of the LED array providing a soft lighting. A person of ordinary skill in the art appreciates that the distance from the diffusers 106 to the LED panel 104 is adjustable. In some embodiments, the diffusers 106 can be instantly replaceable for different lighting effects, such as brighter/dimmer and with lighting patterns.

In some embodiments, the structure and construction of the LED assembly 100 provides an enclosed and snug-fit compartment for efficient heat dissipation.

Further, the curvature structure 112B of the enclosure 112 provides a relatively large thermal barrier between the power supply 110 and the LED panel 104, which allows the emitting of 100+ Watt incandescent equivalent light, which is superior than the typical LED assembly allowing LEDs in the scale of 10-20 Watts. Furthermore, the diamond shape enclosure 112 has a top portion 112C that serves as a cover to enclose the power supply 110 preventing the exposure of the power supply 110.

In some embodiments, a thermally reflective coating is formed on the lighting exposed fixture, such as the surface 104A such that the thermal stress in the power supply compartment is reduced or minimized. In some embodiments, the cover of the assembly/fixture comprises structures that can enhance convective cooling using temperature differentials between the power supply 110 and the immediate ambient atmosphere.

Figure 2:
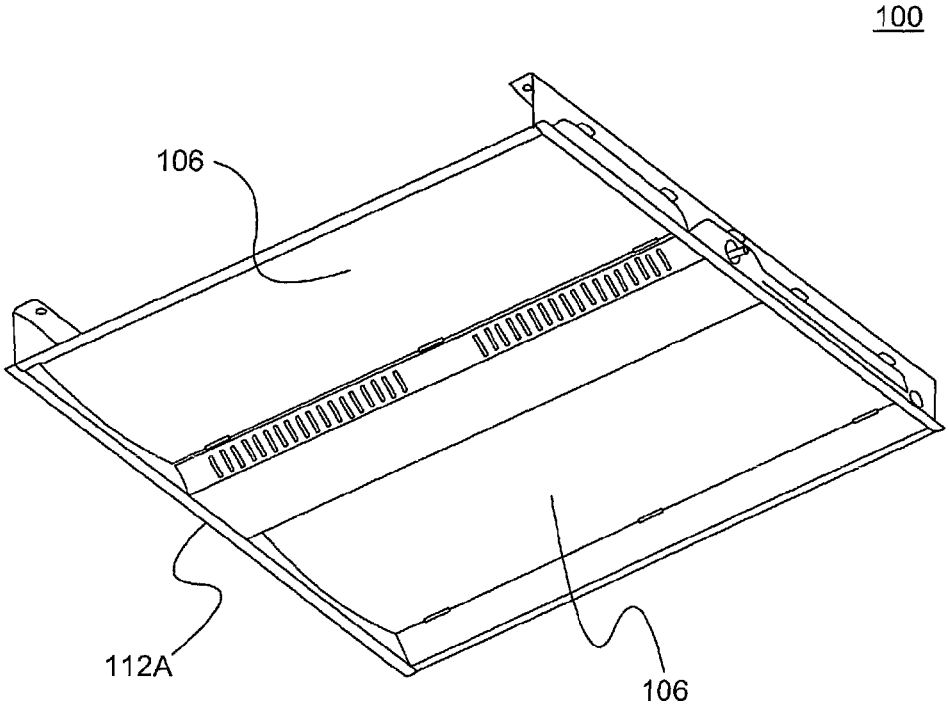
FIG. 2 is a perspective view of the LED assembly 100 in accordance with some embodiments of the present invention.

FIG. 2 is a perspective view of the LED assembly 100 in accordance with some embodiments of the present invention. As shown, the power supply 110 inside the power supply compartment can be covered/concealed by a top cover 112A. The surface of the diffusing lens 106 can be curved (convex and/or concave on either side or both sides) or flat.

Figure 3:
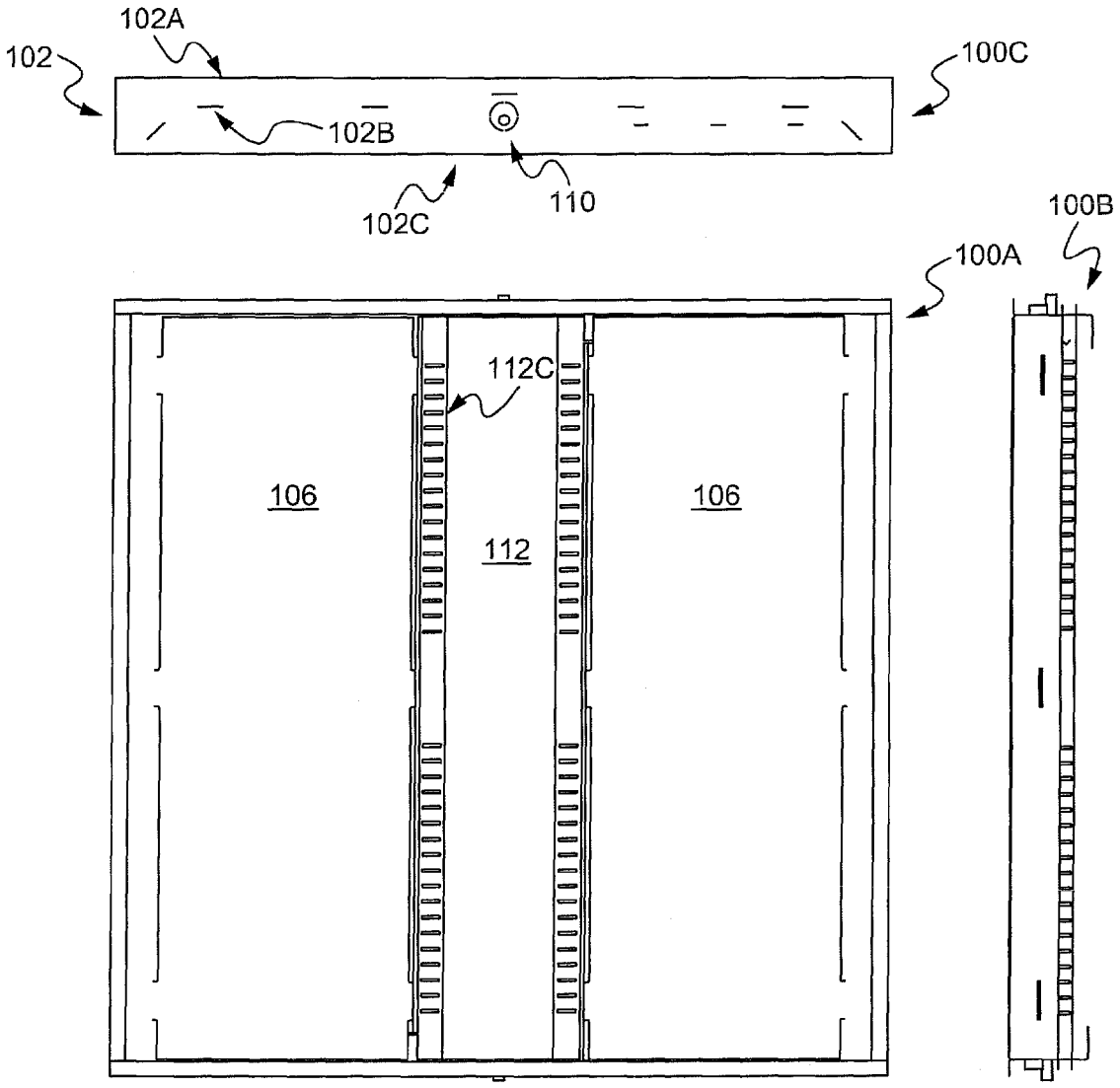
FIG. 3 illustrates a top view 100A and side views 100B and 100C of the LED assembly 100 in accordance with some embodiments of the present invention.

FIG. 3 illustrates a top view 100A and side views 100B and 100C of the LED assembly 100 in accordance with some embodiments of the present invention. As shown in the view 100C, the housing body 102 of the LED assembly 100 can be made by three pieces of sheet metal. The thickness of the LED assembly 100C can be between 50-60 mm and the surface area can be 595 mm×595 mm. A person of ordinary skill in the art will appreciate that the LED assembly can be in any other sizes. The holes 112C on the second sheet metal 102B above first sheet metal 102A can be the holes for dissipating heat from the power supply 110.

Figure 4:
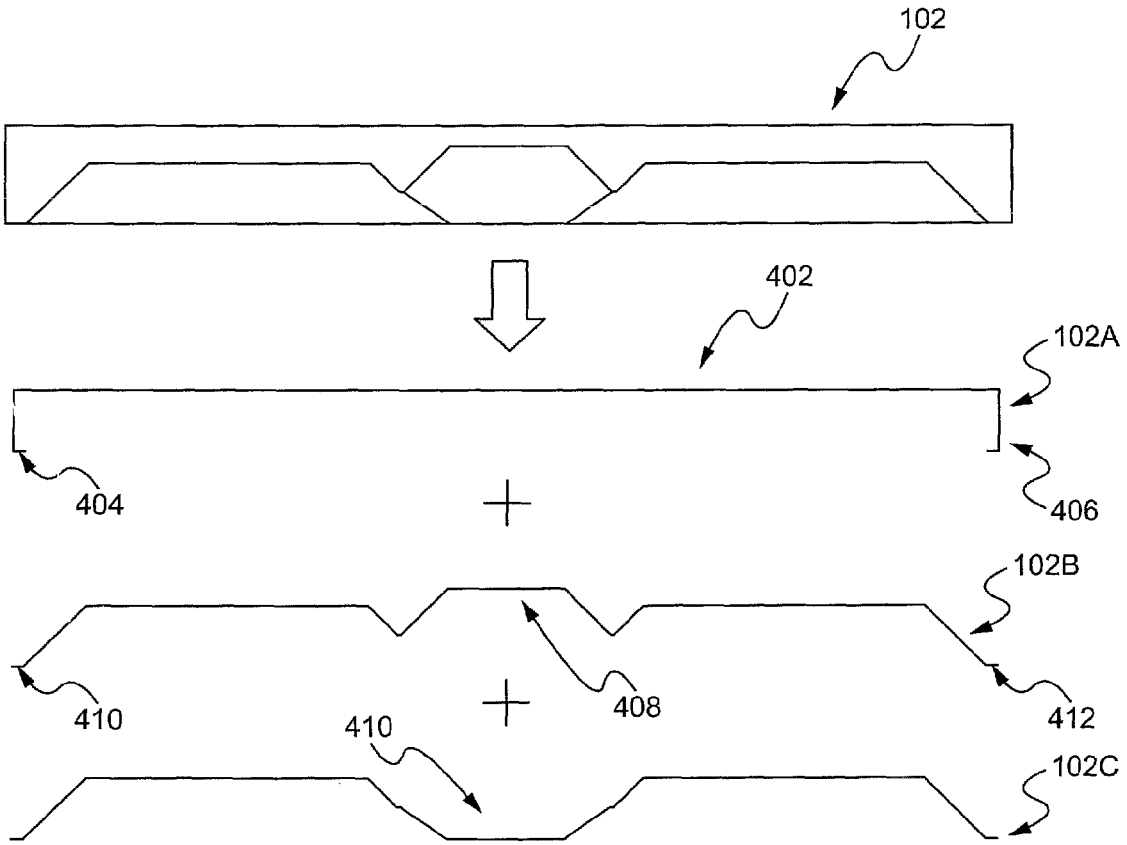
FIG. 4 illustrates the housing body 102 constructed by three pieces sheet metal 102A, 102B, and 102C in accordance with some embodiments of the present invention.

FIG. 4 illustrates the housing body 102 constructed by three pieces sheet metal 102A, 102B, and 102C in accordance with some embodiments of the present invention. The first piece 102A comprises a base 402 having two side arms 404 and 406 bending inwardly for clipping or securing the second piece 102B. The second piece 102B comprises two extending arms 410 and 412 structurally complimentary to the two side arms 404 and 406, such that the second piece 102B can be fixed/immobilized on the first piece 102A. The second piece 102B comprises a recess 408 structured to couple with a power supply. The third piece 102C has a structure parallel to the structure of the second piece 102B except that the central portion is bending outward forming a compartment for fitting the power supply.

Figure 5:
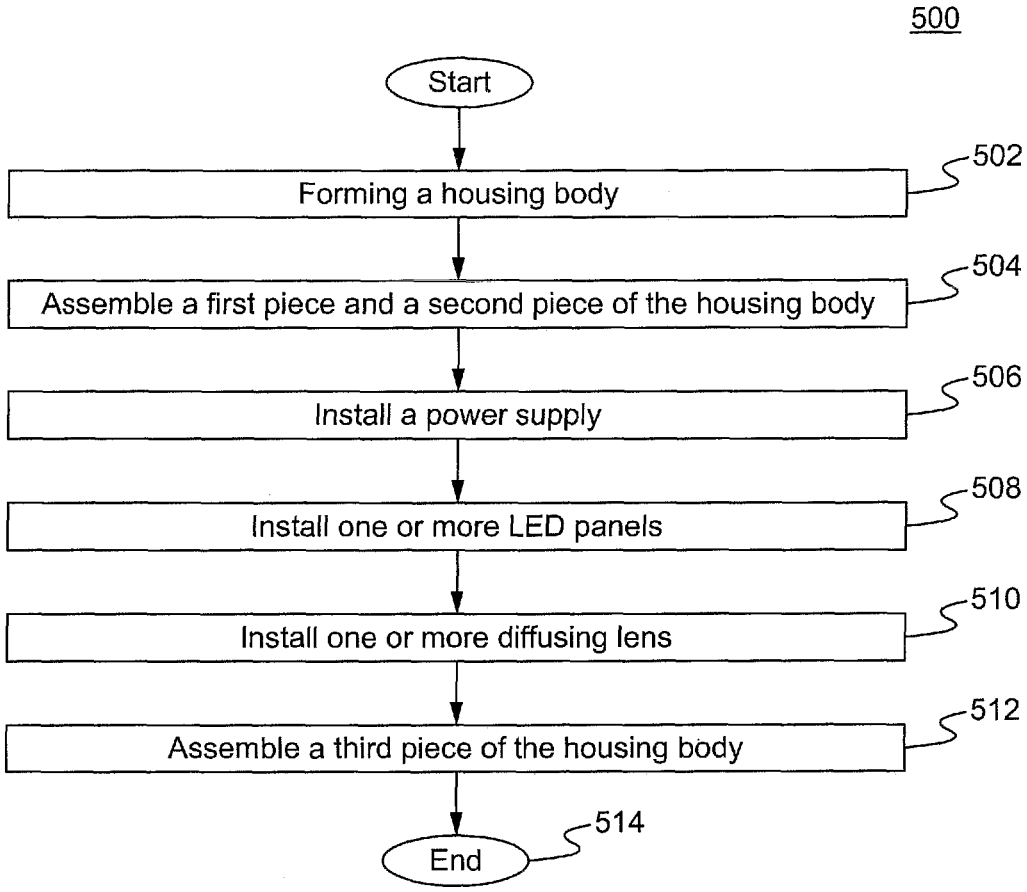
FIG. 5 is a flow chart illustrating a method 500 of manufacturing an LED assembly in accordance with some embodiments of the present invention.

FIG. 5 is a flow chart illustrating a method 500 of manufacturing a T ED assembly in accordance with some embodiments of the present invention. At Step 502, a housing body is formed. In some embodiments, the housing body is constructed with three piece of sheet metals. The shape/contour of the sheet metals can be either stamped and/or machine pressed cut. At Step 504, a first piece and a second piece of the housing body are assembled. At Step 506, a power supply is installed. At Step 508, one or more LED panels are installed. At Step 510, one or ore diffusing lens are installed. At Step 512, a third piece of the hosing body, such as a cover, is assembled on the LED assembly. The method 500 can step at Step 514.

The LED assembly can be utilized to illuminate and used as an indoor lighting. The wattage can include 65 Watts, 130 Watts, and 195 Watts. In some embodiments, the LED assembly comprises dimming drivers.

In operation, the manufacturing of the LED assembly can be done by assembling the housing body, securing the LED panels and diffusing lens, and place a cover on.

The present invention has been described in terms of specific embodiments incorporating details to facilitate the understanding of principles of construction and operation of the invention. Such reference herein to specific embodiments and details thereof is not intended to limit the scope of the claims appended hereto. It is readily apparent to one skilled in the art that other various modifications can be made in the embodiment chosen for illustration without departing from the spirit and scope of the invention as defined by the claims.

What is claimed is:

1. A method of manufacturing a LED assembly comprising:

a. coupling formed sheet metal to form a housing body, wherein the housing body comprises at least two recesses;

b. coupling at least one LED lighting element with each of the at least two recesses, wherein the housing body comprises at least three pieces of sheet metal including a first piece of sheet metal shaped to form the at least two recesses and a first partial portion of an enclosure for the power supply, a second piece of sheet metal shaped to form the at least two recesses and a second partial portion of the enclosure for the power supply and a third piece of sheet metal including upstanding arms hooked to capture and hold the first and the second pieces of sheet metal;

c. enclosing a power supply; and d. coupling one or more diffusing lens to each of the LED lighting element.

2. The method of claim 1, wherein the two recesses are at the two sides of the power supply.

3. The method of claim 1, wherein each of the two recesses comprises a flat area coupling with the LED lighting element.

4. The method of claim 1, wherein the method comprises joining the pieces of sheet metal by clipping together without screws.

5. A lighting assembly comprising:

a. a housing body having an enclosed power supply compartment; and b. a portion of the housing body forming a thermal barrier between the power supply and one or more LED panels, wherein the housing body comprises at least three pieces of sheet metal including a first piece of sheet metal shaped to form at least two recesses and a first partial portion of an enclosure for the power supply, a second piece of sheet metal shaped to form the at least two recesses and a second partial portion of the enclosure for the power supply and a third piece of sheet metal including upstanding arms hooked to capture and hold the first and the second pieces of sheet metal.

6. The lighting assembly of claim 5, wherein the housing body is formed by attaching formed metal sheets.

7. The lighting assembly of claim 5, wherein the LED panels is covered by one or more diffusing lens.

8. The lighting assembly of claim 5, wherein the LED panels are at two sides of the power supply.

9. The lighting assembly of claim 5, further comprising a cover, wherein the cover covers the power supply compartment holding the power supply.

10. The lighting assembly of claim 5, wherein the cover is a perforated stamped piece.

11. The lighting assembly of claim 5, wherein the housing body comprises a thermally reflective coating.

12. The lighting assembly of claim 5, wherein the lighting assembly couples with a LED greater than 100 Watts.

13. A low-profile LED lighting fixture comprising:

a. a body has a thickness less than 70 mm;

b. two lighting areas located at two sides of the fixture;

c. a concave at each of the two lighting areas; and d. a diffusing lens covering each of the lighting areas, wherein the body comprises at least three pieces of sheet metal including a first piece of sheet metal shaped to form at least two recesses and a first partial portion of an enclosure for a power supply, a second piece of sheet metal shaped to form the at least two recesses and a second partial portion of the enclosure for the power supply and a third piece of sheet metal including upstanding arms hooked to capture and hold the first and the second pieces of sheet metal.

14. The low-profile LED lighting fixture of claim 13, further comprising two rows of holes facing each other.

15. The low-profile LED lighting fixture of claim 14, wherein the holes are heat dissipating holes located around a power supply.

16. The low-profile LED lighting fixture of claim 15, further comprising a thermal barrier between the power supply and a LED lighting element.

17. The low-profile LED lighting fixture of claim 13, wherein the body is formed by three pieces of formed sheet metal.

18. The low-profile LED lighting fixture of claim 13, wherein the diffusing lens is lower than a side wall of the body.

* * * * *